US006604546B1

(12) United States Patent
Gilmore

(10) Patent No.: US 6,604,546 B1
(45) Date of Patent: Aug. 12, 2003

(54) HOSE-END CHEMICAL DELIVERY SYSTEM

(75) Inventor: Dan C. Gilmore, Roseville, CA (US)

(73) Assignee: E-Z Flo Injection Systems, Inc., Wexford, PA (US)

( * ) Notice: Subject to any disclaimer, the term of this patent is extended or adjusted under 35 U.S.C. 154(b) by 0 days.

(21) Appl. No.: 10/198,886

(22) Filed: Jul. 19, 2002

Related U.S. Application Data

(63) Continuation-in-part of application No. 10/173,284, filed on Jun. 17, 2002, now Pat. No. 6,546,949, which is a continuation of application No. 09/895,629, filed on Jul. 2, 2001, now Pat. No. 6,453,935.

(51) Int. Cl.[7] ..... F04F 5/10

(52) U.S. Cl. ..... 137/550; 137/268; 422/282; 422/283; 239/310; 251/206

(58) Field of Search ..... 137/268, 553, 137/550; 422/282, 283, 264; 251/206; 239/74, 310

(56) References Cited

U.S. PATENT DOCUMENTS

| | | | | |
|---|---|---|---|---|
| 2,788,244 A | * | 4/1957 | Gilmour | 251/206 X |
| 2,857,202 A | | 10/1958 | Snyder | |
| 3,052,525 A | | 9/1962 | Vogelmann et al. | |
| 3,186,643 A | * | 6/1965 | George et al. | 239/310 |
| 3,455,054 A | | 7/1969 | Tibbals, Jr. | |
| 3,770,205 A | * | 11/1973 | Proctor et al. | 239/318 X |
| 3,809,291 A | | 5/1974 | Purdy | |
| 4,193,516 A | | 3/1980 | Purdy et al. | |
| 4,339,332 A | | 7/1982 | Jasperson | |
| 4,475,689 A | | 10/1984 | Hauger et al. | |
| 4,846,214 A | | 7/1989 | Strong | |
| 5,010,912 A | | 4/1991 | Riding | |
| 5,253,677 A | | 10/1993 | Sand | |
| 5,484,106 A | | 1/1996 | Gilmond | |
| 5,544,810 A | | 8/1996 | Horvath, Jr. et al. | |
| 6,039,065 A | | 3/2000 | Gagliardo | |
| 6,425,534 B2 | * | 7/2002 | Ketcham et al. | 251/206 X |

* cited by examiner

*Primary Examiner*—Kevin Lee
(74) *Attorney, Agent, or Firm*—Gary R. Jarosik; Mark R. Galis

(57) ABSTRACT

A chemical delivery system having a body defining a main fluid flow passage through which a fluid passes and a storage tank for holding a chemical. An inlet nozzle delivers a quantity of the fluid in the main fluid flow passage to the storage tank to be mixed with the chemical and an outlet nozzle return a quantity of the fluid mixed with the chemical from the storage tank to the main fluid flow passage. An adjustment dial having a plurality of orifices of varying diameter that are capable of being individually placed into relation with the inlet nozzle may be used to control the amount of fluid that enters the first inlet nozzle from the main fluid flow passage. Furthermore, an outlet nozzle trap in fluid communication with a vent port of the outlet nozzle may be placed in fluid communication with a fill control port of the inlet nozzle. The fill control port is used to direct fluid to the outlet nozzle trap to control venting of air from the storage tank to the main fluid flow passage via the vent port.

40 Claims, 4 Drawing Sheets

HOSE-END CHEMICAL DELIVERY SYSTEM

RELATED APPLICATION INFORMATION

This application is a continuation-in-part of U.S. patent application Ser. No. 10/173,284, filed Jun. 17, 2002, U.S. Pat. No. 6,546,949 which is a continuation of U.S. patent application Ser. No. 09/895,629, filed on Jul. 2, 2001, U.S. Pat. No. 6,453,935 both of which are incorporated herein by reference in their entirety.

BACKGROUND OF THE INVENTION

This invention relates generally to chemical delivery systems and, more particularly, to a hose-end chemical delivery system.

Hose-end chemical delivery systems for spraying chemicals such as insecticides, herbicides, and fertilizers are known in the art. For example, U.S. Pat. No. 4,475,689 describes a variable dilution ratio hose-end sprayer having a rotatable selector dial. Formed in the rotatable selector dial is a plurality of orifices. The orifices are adapted to intersect an output fluid passageway that extends from a fluid container to a mixing chamber. The mixing chamber is provided for mixing selected amounts of fluid from the fluid container with water that enters the mixing chamber from the hose to which the delivery system is attached. The diameter of each orifice of the rotatable selector dial is proportioned to provide a desired final dilution ratio of the fluid to be siphoned from the fluid container. The orifices extend through the selector dial and lie on a circle concentric with the axis of the selector dial. The orifices also have a radius selected to intersect the axis of the output fluid passageway.

SUMMARY OF THE INVENTION

An improved chemical delivery system is described having a body defining a main fluid flow passage through which a fluid passes and a storage tank for holding a chemical. An inlet nozzle delivers a quantity of the fluid in the main fluid flow passage to the storage tank to be mixed with the chemical and an outlet nozzle is used to return a quantity of the fluid mixed with the chemical from the storage tank to the main fluid flow passage. An adjustment dial having a plurality of orifices of varying diameter that are capable of being individually placed into relation with the inlet nozzle may be used to control the amount of fluid that enters the inlet nozzle from the main fluid flow passage. Furthermore, an outlet nozzle trap in fluid communication with a vent port of the outlet nozzle may be placed in fluid communication with a fill control port of the inlet nozzle. The fill control port is used to direct fluid to the outlet nozzle trap to control venting of air from the storage tank to the main fluid flow passage via the vent port.

A better understanding of the objects, advantages, features, properties and relationships of the invention will be obtained from the following detailed description and accompanying drawings which set forth illustrative embodiments and which are indicative of the various ways in which the principles of the invention may be employed.

BRIEF DESCRIPTION OF THE DRAWINGS

For a better understanding of the invention, reference may be had to preferred embodiments shown in the attached drawings in which.

DETAILED DESCRIPTION

Figure 1:
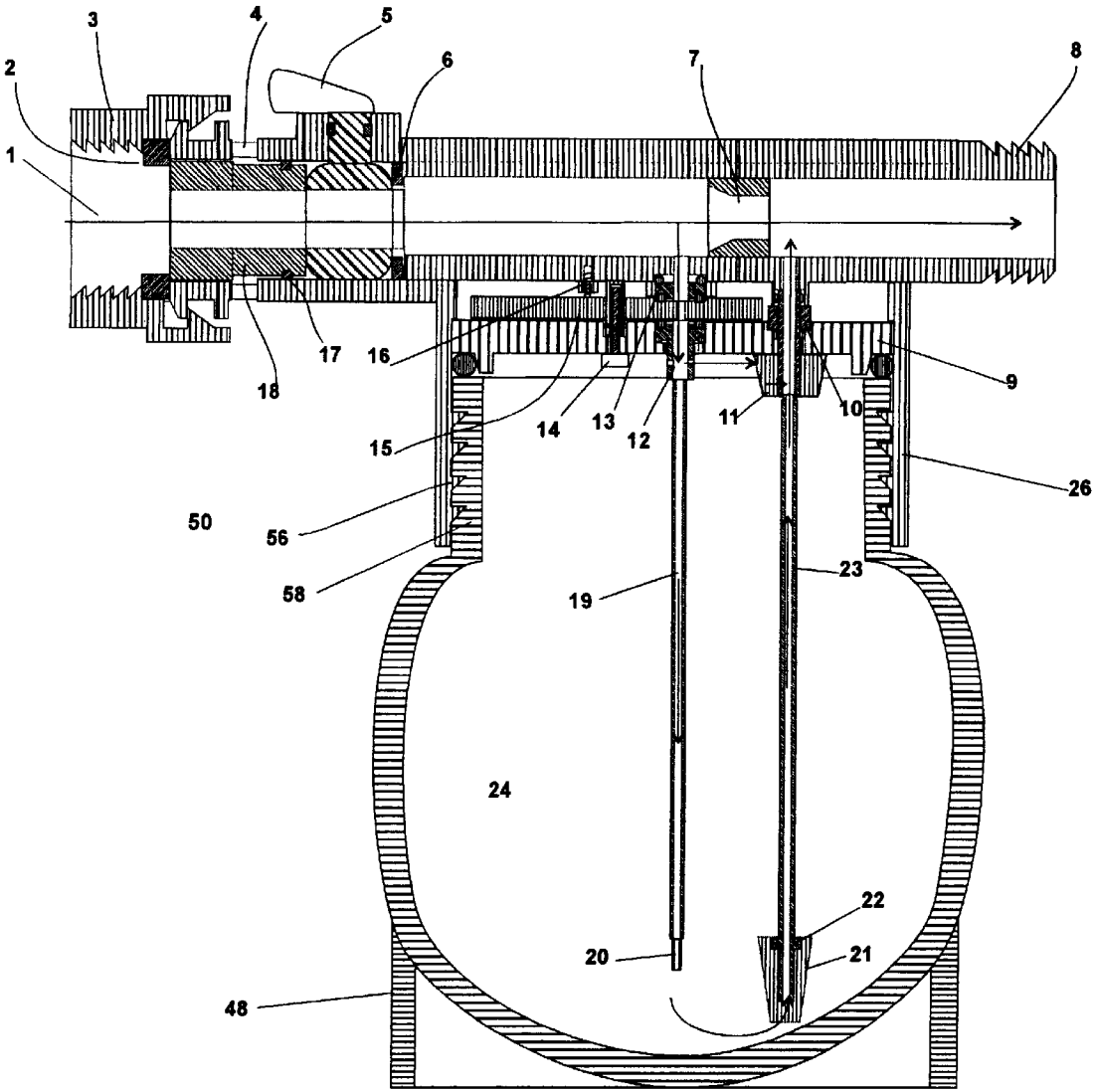
FIG. 1 illustrates a cross-sectional view of an exemplary hose-end chemical delivery system constructed in accordance with the principles of the subject invention.

Turning now to the figures, wherein like reference numerals refer to like elements, there is illustrated in FIG. 1 an exemplary hose-end chemical delivery system 50 comprising a cap 26 and a storage tank 24. As will be appreciated, the storage tank 24 is adapted to contain a chemical to be sprayed, for example, a water soluble fertilizer. To sealingly secure the storage tank 24 to the cap 26, the exterior of the storage tank 24 may be provided with threads 58 adapted to mate with threads 56 formed on the interior of the cap 26. Additional means for securing the storage tank 24 to the cap 26, such as providing a snap-fit connection, are also contemplated.

As illustrated, the chemical delivery system 50 is adapted to be connected to a source of fluid, such as water. To this end, the cap 26 may be provided with a threaded, female connector 3 that is adapted to mate with a threaded, male connector of a conventional garden hose. Preferably, the connector 3 is attached to the remaining components of the cap 26 by means of a swivel connector. A seal 2 may be provided to prevent fluid leakage from the area of any such swivel attachment. When the chemical delivery system 50 is attached to a garden hose, fluid flows in the directions indicated by the fluid flow passage 1 that is illustrated in FIG. 1.

To prevent the backflow of fluid from the chemical delivery system 50 to the fluid supply, a vacuum breaker 18 may be provided within the main fluid flow passage formed in the cap 26. In this regard, the main fluid flow passage extends between the input, illustrated as connector 3, and an output. While not intended to be limiting, the illustrated output comprises a threaded, male connector 8 adapted to releasably mate with a spray head 27. As will be appreciated, the vacuum breaker 18 operates in connection with a vacuum breaker exhaust 4, formed in the cap 26 adjacent to the vacuum breaker 18, that provides a vent to the atmosphere if a pressure reversal occurs. A seal 17 may be positioned between the vacuum breaker 18 and the interior of the main fluid flow passage to prevent leakage of fluid through the vacuum breaker exhaust 4.

Figure 2:
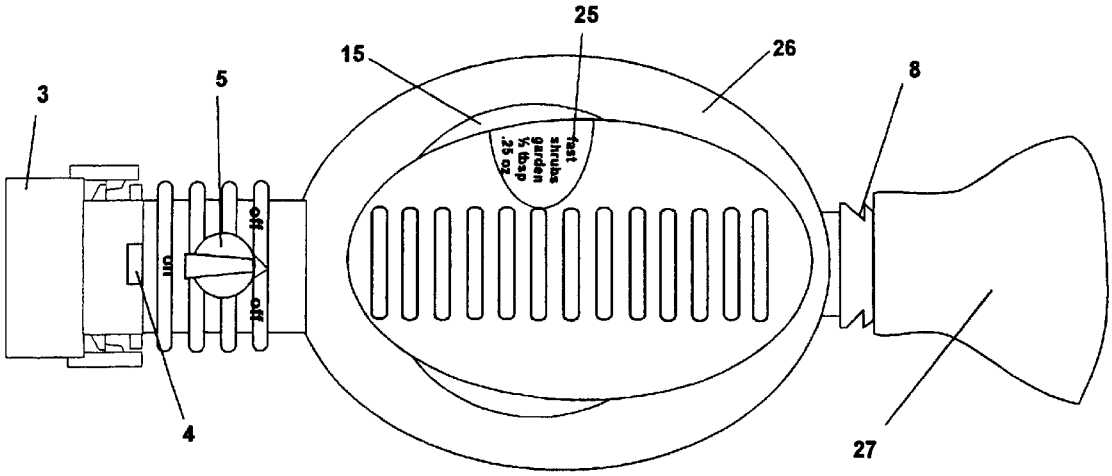
FIG. 2 illustrates a top view of an exemplary cap of the hose-end chemical delivery system of FIG. 1.

While not required, the cap 26 may further include a shut off valve 5, illustrated in FIGS. 1 and 2. The shut off valve 5 allows a user to manually control the amount of fluid that is permitted to flow through the main fluid passage of the cap 26. The shut off valve 5 may be a ball valve such as illustrated in the figures, a pistol grip lever actuated valve (e.g., like a gas pump valve), or the like without limitation. A seal 6 may be positioned adjacent to the shut off valve 5 to prevent fluid leakage. Further associated with the main fluid passage and positioned between the inlet (e.g., connector 3) and the outlet (e.g., connector 8) is a flow restrictor 7. The flow restrictor 7 functions to restrict the amount of fluid that flows through the main fluid passage to thereby create back pressure that further functions to divert fluid into the storage tank 24 and to siphon fluid from the storage tank 24.

More specifically, fluid diverted from the main fluid passage is directed to an inlet nozzle 12 that is in fluid communication with the main fluid passage. As illustrated in FIG. 1, the fluid communication between the main fluid passage and the inlet nozzle 12 is via an orifice formed in the main fluid passage on the upstream side of the flow restrictor 7, an upper inlet nozzle 13, and an adjustment dial 15. The adjustment dial 15 is provided as a means for allowing a user to manually adjust the amount of fluid that is permitted to flow into the inlet nozzle 12 (i.e., to thereby control the rate of chemical mixing). To this end, the adjustment dial 15 includes a plurality of orifices 28 having various diameters (e.g., having diameters that range from approximately 0.030 to 0.060 inches) that may be selectively disposed between the upper nozzle 13 and the inlet nozzle 12.

Figure 3:
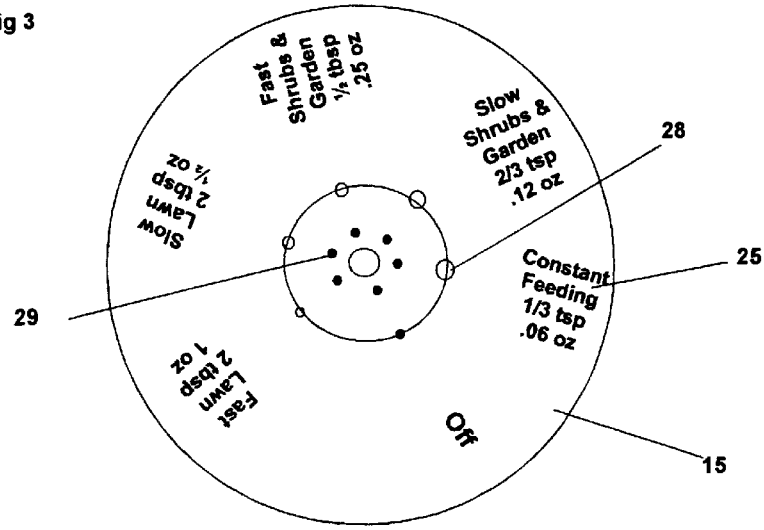
FIG. 3 illustrates a top view of an exemplary selector dial of the hose-end chemical delivery system of FIG. 1.

As illustrated in FIGS. 2 and 3, the plurality of orifices 28 are arranged around the adjustment dial 15 such that the orifices 28 lie on a circle concentric with the axis of the adjustment dial 15. The orifices 28 also have a radius selected to intersect the axis of the nozzles 12 and 13. Associated with each of the orifices 28 may be a setting indicator 25 that is visible to the user such that the user may discern which of the orifices is presently associated with the inlet nozzle 12.

To allow the user to selectively associate one of the orifices 28 with the inlet nozzle 12, the adjustment dial 15 is adapted to be rotatable. To maintain the orifices 28 in the proper orientation with respect to the nozzles 12 and 13, the adjustment dial 15 may be provided with a detent mechanism. While not intended to be limiting, the illustrated detent mechanism is comprised of indentations 29 arranged in a concentric circle about the dial 15 that cooperate with a spring loaded pin 16 that is mounted within the cap 26. The adjustment dial 15 may be rotated about a retaining screw 14 that is adapted to mate with an adapter plate 9 that is provided to maintain the adjustment dial 15, inlet nozzles 12 and 13, and an outlet nozzle 10 within the cap 26. A seal 33 may be provided between the adjustment dial 15 and the inlet nozzle 12 to prevent fluid leakage. For the same purpose, a seal 34 may also be positioned between the inlet nozzle 12 and the adapter plate 9.

Figure 4:
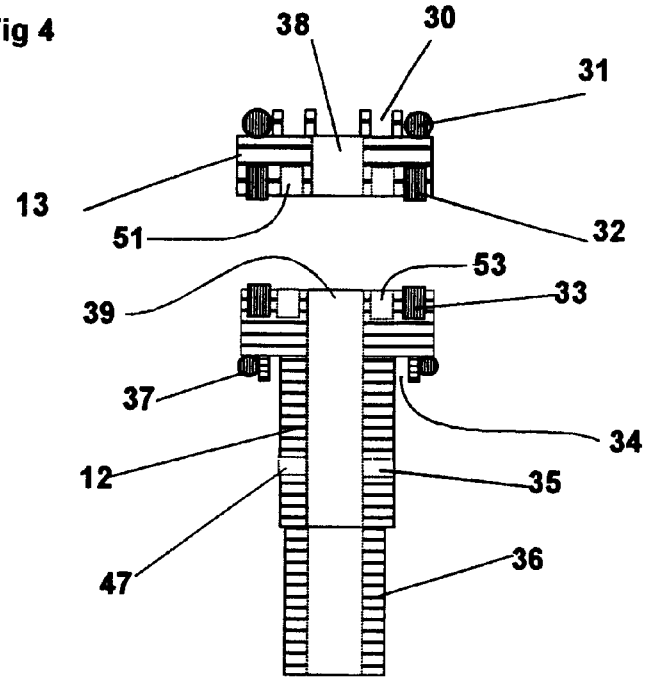
FIG. 4 illustrates a cross-sectional view of an exemplary inlet nozzle of the hose-end chemical delivery system of FIG. 1.

As noted previously, fluid is directed from the main fluid passage to the adjustment dial 15 and, in turn, the input nozzle 12 via a top inlet nozzle 13. Seals 31 and 32 may be used to prevent leakage of fluid from areas adjacent to this flow passage. In this regard, the dual seals 31 and 32 associated with the top inlet nozzle 13 (as well as the dual seals 33 and 34 associated with the nozzle 12) are especially useful to prevent leakage when the adjustment dial 15 is being rotated during those times that the system 50 is under pressure from the source of fluid. To further enhance the usefulness of the seals, it is preferred that the inlet nozzles (as well as the outlet nozzle) be designed so as to add increasingly positive pressure to the seals as pressure is increased. To this end, as illustrated in FIG. 4, the top inlet nozzle 13 may include a pressure chamber 30 and the lower inlet nozzle 12 may include a pressure chamber 34. Optional cavities 51 and 53 may be formed in the upper inlet nozzle 12 and lower inlet nozzle 14, respectively, to provide an additional seal when the adjustment dial 15 is being rotated while the system is under fluid pressure.

The pressure chamber 30 communicates with fluid in the main flow line such that flow line pressure captured in the pressure chamber 30 forces the top inlet valve to move the top inlet lower seal 32 into further engagement against the adjustment dial 15. Similarly, the pressure chamber 34 communicates with pressure in the storage tank 24 such that storage tank pressure captured in the pressure chamber 34 forces the lower inlet valve to move the bottom inlet nozzle seal 33 against the adjustment dial. It will be appreciated that, as pressure increases in either the main flow line or the storage tank, a stronger seal is created against the adjustment dial 15.

For use in mixing fluid with chemical contained within the storage tank 24, an inlet dip tube 19, that extends towards the bottom of the storage tank 24, is connected to a dip tube connection 36 of the inlet nozzle 12. As illustrated in FIG. 1, an agitation nozzle 20 is further connected to end of the inlet dip tube 19 such that fluid exiting the agitation nozzle 20 will cause chemical contained within the storage tank 24 to mix with fluid that has been delivered to the storage tank 24. The inlet nozzle 12 also includes a fluid control port 47 that is used to layer fluid over the top of the chemical solution located at the bottom of the storage tank 24. This manner of delivering fluid to the storage tank 24 helps to stabilize the chemical solution to create a more even injection rate. In addition, this manner of delivering fluid to the storage tank 24 helps to clear the expansion tank 24 of any dye when the chemical has been exhausted during spraying. This is particularly useful since it eliminates the situation where a user thinks chemical remain in the storage tank 24 just because the fluid remains dyed. It is to be appreciated that the control port 47 is optional.

To further assist in the even mixing of the chemical and the fluid, especially in the case of water soluble fertilizers, the storage tank 24 may be provided with a domed bottom into which the nozzle 20 extends. In this manner, the agitation caused by fluid exiting the nozzle 10 occurs at the bottom most portion of the storage tank 24. Additionally, the domed bottom improves the strength of the storage tank 24 in a pressurized environment. To allow a storage tank 24 with a domed bottom to sit with stability, a ring 48 may be provided that is adapted to mate with the bottom of the storage tank 24, for example, by being snap-fit thereto.

Figure 5:
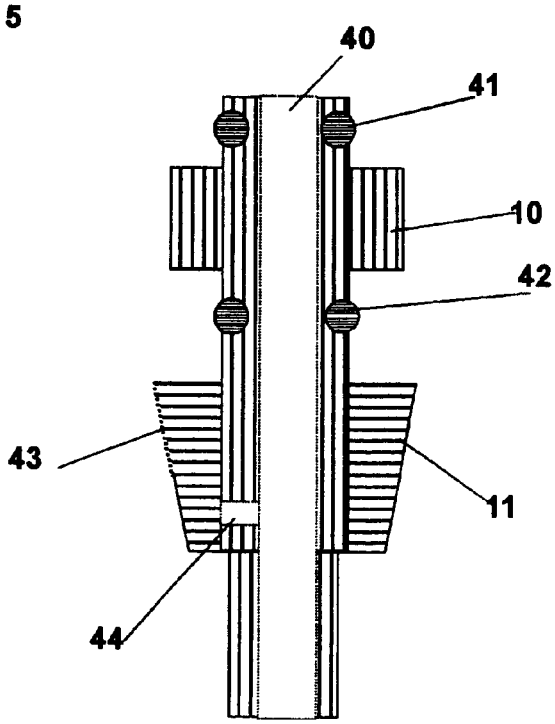
FIG. 5 illustrates a cross-sectional view of an exemplary outlet nozzle of the hose-end chemical delivery system of FIG. 1.

For use in venting air during filling of the storage tank 24 and for returning fluid mixed with chemical to the main fluid passage once the filling process is complete, an outlet nozzle 10, having a mounted outlet dip tube 23, is placed in fluid flow communication with the main fluid passage via an orifice positioned in the main fluid passage located downstream of the flow restrictor 7. Specifically, the outlet nozzle 10, illustrated in FIG. 5, has a first body section and a second body section that defines a fluid flow passage 40 that is in fluid communication with the main fluid passage. As seen in FIG. 1, the first body section of the outlet nozzle 10 is disposed between the main fluid passage and the adapter plate 9 and dual seals 41 and 42 may be provided to prevent fluid leakage from areas where the elements meet. The second body section of the outlet nozzle 10 extends from the adapter plate 9 towards the storage tank 24 and carries an outlet nozzle trap 11. Preferably, the top of the outlet nozzle trap 11 engages the bottom of the adapter plate 9.

The outlet nozzle trap 1 has a perforated opening 43 for accepting fluid. During the filling stage of the storage tank 24, fluid is directed to the perforated opening 43 from a fill control port 35 formed in the inlet nozzle 12. This fluid may then be used to inhibit the venting of air from the storage tank 24 via a vent 44 formed in the outlet nozzle 10 that is positioned within the nozzle trap 11. The sizing of the fill control port 35 relative to the size of the outlet nozzle vent 44 will, therefore, regulate the amount of air capable of being vented via the vent 44 which, in turn, regulates the speed by which the storage tank 24 fills. As will be appreciated, controlling the fill speed in turn controls the initial injection rates, mixing, etc. Furthermore, the action between the port 35 and the port 44 helps to eliminate plugging and spurting. For example, if back pressure develops due to air resistance at the screen 21, the system will function to automatically force more air or fluid out of port 44. Without such a system, back pressure would develop until enough force was created to push the resisting element through the screen 21 which, when the release occurred, would cause spurting. If the resisting element were not forced through the screen, a plug would occur.

Figure 6:
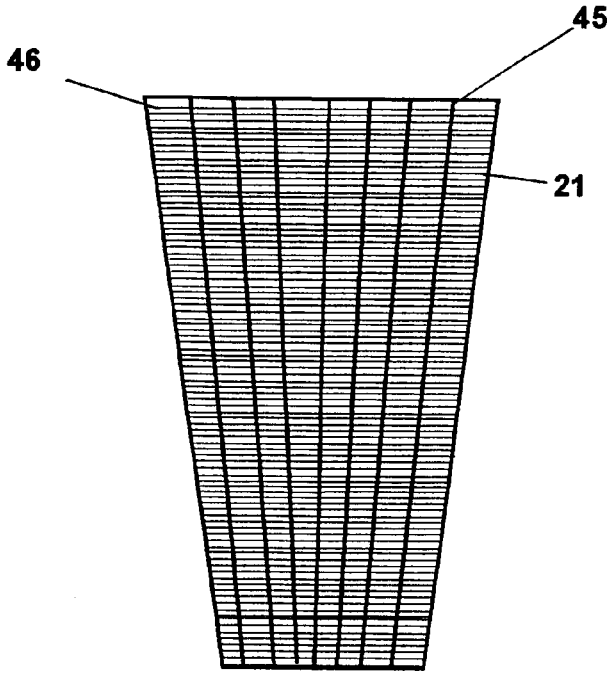
FIG. 6 illustrates a side view of an exemplary output dip tube screen of the hose-end chemical delivery system of FIG. 1.
Figure 7:
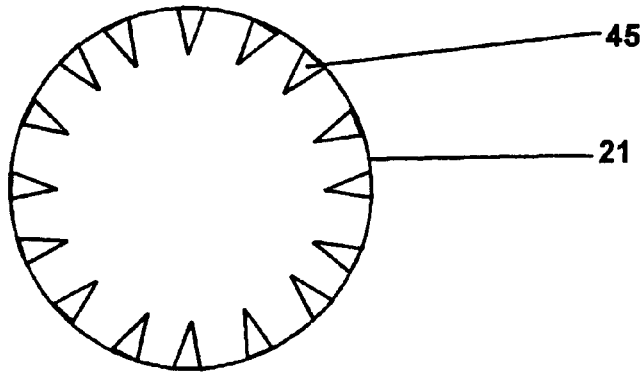
FIG. 7 illustrates a top view of the dip tube screen of FIG. 6.

Once the fluid in the storage tank 24 reaches the level of the perforated opening 43 so as to be in fluid communication with the outlet nozzle vent 44, the filling stage is complete (i.e., there no longer remains air to vent) and fluid mixed with chemical may now be siphoned into the main fluid passage from the storage tank 24 via the outlet dip tube 23 and output nozzle 10. In this regard, fluid is drawn into the outlet dip tube 23 via a bottom outlet nozzle 22 that is attached to the bottom of the outlet dip tube 23. Further associated with the bottom outlet nozzle 22 is a dip tube screen 21, illustrated in FIGS. 6 and 7, having a non-clogging design. In the illustrated embodiment, the screen 21 comprises a screen meshing 46 (for example, of polypropylene) attached to vertical support rods 45. The relationship of the vertical support rods 45 is such that the narrowest point between adjacent vertical support rods 45 is at the point where the support rods 45 engage the screen meshing 46. In this manner, anything that is capable of passing through the support rods 45 at their outermost points of association will be able to pass through into the interior of the screen 21. To provide a more consistent flow into the outlet dip tube 23, it is preferred that the outlet bottom nozzle 22 extends into the middle of the screen 21.

While specific embodiments of the invention have been described in detail, it will be appreciated by those skilled in the art that various modifications and alternatives to those details could be developed in light of the overall teachings of the disclosure. For example, it is to be appreciated that various elements, such as the dip tubes, ports, etc., could be eliminated without departing from the spirit of the invention. Accordingly, the particular arrangement disclosed is meant to be illustrative only and not limiting as to the scope of the invention which is to be given the full breadth of the appended claims and any equivalents thereof.

What is claimed is:

1. A chemical delivery system, comprising a body defining a main fluid flow passage through which a fluid passes;

a storage tank for holding a chemical;

a first inlet nozzle by which a quantity of the fluid from the main fluid flow passage is delivered to the storage tank to be mixed with the chemical;

an outlet nozzle by which a quantity of the fluid mixed with the chemical is returned to the main fluid flow passage from the storage tank; and an adjustment dial having a plurality of orifices of varying diameter that are capable of being individually placed into relation with the first inlet nozzle to control the amount of fluid that enters the first inlet nozzle from the main fluid flow passage.

2. The chemical delivery system as recited in claim 1, wherein the body comprises a cap attachable to the storage tank.

3. The chemical delivery system as recited in claim 1, further comprising a flow restrictor disposed within the main fluid flow passage to create a high pressure side and a low pressure side and wherein the first inlet nozzle is in fluid communication with the high pressure side and the outlet nozzle is in fluid communication with the low pressure side.

4. The chemical delivery system as recited in claim 1, wherein the main body further comprises a hose connector.

5. The chemical delivery system as recited in claim 4, wherein the hose connector is attached to the main body by means of a swivel connection.

6. The chemical delivery system as recited in claim 1, further comprising a spray head releasably attachable to the main body.

7. The chemical delivery system as recited in claim 1, further comprising a second inlet nozzle disposed intermediate the adjustment dial and the main fluid flow passage defining a second fluid flow passage by which the first inlet nozzle is in fluid communication with the main fluid flow passage.

8. The chemical delivery system as recited in claim 7, further comprising a seal positioned between the second inlet nozzle and the adjustment dial.

9. The chemical delivery system as recited in claim 8, wherein the second inlet nozzle comprises a pressure chamber in communication with pressure in the main flow passage.

10. The chemical delivery system as recited in claim 7, further comprising a seal positioned between the first inlet nozzle and the adjustment dial.

11. The chemical delivery system as recited in claim 10, wherein the first inlet nozzle comprises a pressure chamber in communication with pressure in the storage tank.

12. The chemical delivery system as recited in claim 1, further comprising an inlet dip tube extending into the storage tank and attached to the first inlet nozzle.

13. The chemical delivery system as recited in claim 12, further comprising an agitation nozzle attached to the inlet dip tube opposite the first inlet nozzle.

14. The chemical delivery system as recited in claim 13, wherein the first inlet nozzle has a fluid control port for layering fluid over the fluid mixed with the chemical in the storage tank.

15. The chemical delivery system as recited in claim 13, wherein the storage tank has a domed bottom.

16. The chemical delivery system as recited in claim 15, further comprising a ring stand attachable to the domed bottom of the storage tank.

17. The chemical delivery system as recited in claim 1, further comprising an outlet dip tube extending into the storage tank and attached to the outlet nozzle.

18. The chemical delivery system as recited in claim 17, further comprising a dip tube screen attached to the outlet dip tube opposite the outlet nozzle.

19. The chemical delivery system as recited in claim 18, wherein the dip tube screen is non-clogging.

20. The chemical delivery system as recited in claim 19, wherein the dip tube screen comprises a plurality of support rods and a meshing attached to the plurality of support rods.

21. The chemical delivery system as recited in claim 20, wherein the plurality of support rods are arranged such that a narrowest distance between adjacent support rods is located proximate to the meshing.

22. The chemical delivery system as recited in claim 19, wherein the outlet dip tube extends to an approximate mid-point within the dip tube screen.

23. The chemical delivery system as recited in claim 1, further comprising an outlet nozzle trap, having an opening, associated with the outlet nozzle and wherein the first inlet nozzle has a fill control port, the outlet nozzle has a vent port in fluid communication with the outlet nozzle trap, and the fill control port directs fluid to the opening of the nozzle trap.

24. The chemical delivery system as recited in claim 1, further comprising a vacuum breaker associated within the main fluid flow passage.

25. The chemical delivery system as recited in claim 1, further comprising a shut off valve associated with the main fluid flow passage.

26. The chemical delivery system as recited in claim 1, wherein the adjustment dial is adapted to be rotatable.

27. The chemical delivery system as recited in claim 26, wherein the adjustment dial comprises a plurality of markings each associated with one of the plurality of orifices to provide a visual indication as to which one of the plurality of orifices is associated with the first inlet nozzle.

28. A chemical delivery system, comprising:

a body defining a main fluid flow passage through which a fluid passes;

a storage tank for holding a chemical;

an inlet nozzle, having a fill control port, by which a quantity of the fluid in the main fluid flow passage is delivered to the storage tank to be mixed with the chemical;

an outlet nozzle, having a vent port, by which a quantity of the fluid mixed with the chemical is returned to the main fluid flow passage from the storage tank; and an outlet nozzle trap, having an opening, in fluid communication with the vent port of the outlet nozzle;

wherein the fill control port directs fluid to the opening of outlet nozzle trap to fill the outlet nozzle trap to control venting of air from the storage tank to the main fluid flow passage via the vent port.

29. The chemical delivery system as recited in claim 28, wherein the inlet nozzle has a fluid control port for layering fluid over the fluid mixed with the chemical in the storage tank.

30. The chemical delivery system as recited in claim 28, further comprising an inlet dip tube attached to the inlet nozzle and extending into the storage tank.

31. The chemical delivery system as recited in claim 30, further comprising an agitation nozzle attached to the inlet dip tube opposite the inlet nozzle.

32. The chemical delivery system as recited in claim 28, wherein the storage tank has a domed bottom.

33. The chemical delivery system as recited in claim 32, further comprising a ring stand attachable to the domed bottom of the storage tank.

34. The chemical delivery system as recited in claim 28, wherein the main body comprises a cap attachable to the storage tank.

35. The chemical delivery system as recited in claim 28, further comprising an outlet dip tube attached to the outlet nozzle and extending into the storage tank.

36. The chemical delivery system as recited in claim 35, further comprising a dip tube screen attached to the outlet dip tube opposite the outlet nozzle.

37. The chemical delivery system as recited in claim 36, wherein the dip tube screen is non-clogging.

38. The chemical delivery system as recited in claim 37, wherein the dip tube screen comprises a plurality of support rods and a meshing attached to the plurality of support rods.

39. The chemical delivery system as recited in claim 38, wherein the plurality of support rods are arranged such that a narrowest distance between adjacent support rods is located proximate to the meshing.

40. The chemical delivery system as recited in claim 39, wherein the outlet dip tube extends to an approximate mid-point of the dip tube screen.

* * * * *